US009852688B2

(12) United States Patent
Lee et al.

(10) Patent No.: US 9,852,688 B2
(45) Date of Patent: Dec. 26, 2017

(54) PIXEL AND ORGANIC LIGHT-EMITTING DISPLAY APPARATUS INCLUDING THE SAME

(71) Applicant: SAMSUNG DISPLAY CO., LTD., Yongin-si, Gyeonggi-do (KR)

(72) Inventors: Changho Lee, Yongin-si (KR); Keumnam Kim, Yongin-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 28 days.

(21) Appl. No.: 14/929,198

(22) Filed: Oct. 30, 2015

(65) Prior Publication Data

US 2016/0125802 A1 May 5, 2016

(30) Foreign Application Priority Data

Oct. 30, 2014 (KR) ..... 10-2014-0149329

(51) Int. Cl.
*G09G 5/00* (2006.01)
*G09G 3/3233* (2016.01)

(52) U.S. Cl.
CPC ... *G09G 3/3233* (2013.01); *G09G 2300/0819* (2013.01); *G09G 2300/0861* (2013.01); *G09G 2310/0262* (2013.01)

(58) Field of Classification Search
CPC ..... G09G 3/3233; G09G 2310/0262; G09G 2300/0861; G09G 2300/0819
See application file for complete search history.

(56) References Cited

U.S. PATENT DOCUMENTS 7,656,369 B2 * 2/2010 Chung ..... G09G 3/3233 315/169.3
8,344,982 B2 * 1/2013 Senda ..... G09G 3/3233 345/76
9,019,191 B2 * 4/2015 Woo ..... H05B 37/02 345/100
9,349,321 B2 * 5/2016 Chen ..... G09G 3/3258
(Continued)

FOREIGN PATENT DOCUMENTS

KR 10-0635511 B1 10/2006
KR 10-2007-0049907 A 5/2007
(Continued)

*Primary Examiner* — Patrick Edouard
*Assistant Examiner* — Joseph Fox
(74) *Attorney, Agent, or Firm* — Lewis Roca Rothgerber Christie LLP

(57) ABSTRACT

A pixel including an organic light-emitting diode, a capacitor, a first transistor including a gate electrode connected to a second node, a first electrode connected to a first source voltage line, and a second electrode configured to output a current corresponding to a voltage applied to the second node, a second transistor including a gate electrode connected to a first scan line, an electrode connected to a data line, a third transistor including a gate electrode connected to the first scan line, a first electrode connected to the first transistor, and a second electrode connected to the first transistor, a fourth transistor including a gate electrode connected to a second scan line, a first electrode connected to the first transistor, and a second electrode connected to an initialization voltage line, and a fifth transistor including a gate electrode and an electrode connected to an emission control line.

13 Claims, 4 Drawing Sheets

(56) References Cited

U.S. PATENT DOCUMENTS

| | | | | |
|---|---|---|---|---|
| 2005/0007316 | A1* | 1/2005 | Akimoto | G09G 3/3233 345/76 |
| 2006/0125737 | A1* | 6/2006 | Kwak | G09G 3/3233 345/76 |
| 2007/0075937 | A1 | 4/2007 | Kim | |
| 2007/0080905 | A1* | 4/2007 | Takahara | G09G 3/3233 345/76 |
| 2007/0103406 | A1 | 5/2007 | Kim | |
| 2008/0180422 | A1* | 7/2008 | Kusafuka | G09G 3/3283 345/204 |
| 2010/0309187 | A1* | 12/2010 | Kang | G09G 3/3233 345/211 |
| 2011/0090213 | A1* | 4/2011 | Han | G09G 3/3233 345/213 |
| 2011/0115764 | A1* | 5/2011 | Chung | G09G 3/3233 345/205 |
| 2011/0115772 | A1* | 5/2011 | Chung | G09G 3/3233 345/211 |
| 2011/0157126 | A1* | 6/2011 | Chung | G09G 3/3233 345/211 |
| 2011/0157135 | A1 | 6/2011 | Lee et al. | |

FOREIGN PATENT DOCUMENTS

| | | | |
|---|---|---|---|
| KR | 10-2011-0078787 | A | 7/2011 |
| KR | 10-2012-0069137 | A | 6/2012 |

* cited by examiner

PIXEL AND ORGANIC LIGHT-EMITTING DISPLAY APPARATUS INCLUDING THE SAME

CROSS-REFERENCE TO RELATED APPLICATION

This application claims priority to and the benefit of Korean Patent Application No. 10-2014-0149329, filed on Oct. 30, 2014, in the Korean Intellectual Property Office, the disclosure of which is incorporated herein in its entirety by reference.

BACKGROUND

1. Field

One or more exemplary embodiments relate to a pixel and an organic light-emitting display apparatus including the same.

2. Description of the Related Art

Among display apparatuses, organic light-emitting display apparatuses are attracting a lot of attention. The organic light-emitting display apparatus has self-emitting characteristic, and does not use a separate light source, unlike liquid crystal display (LCD) apparatuses, thereby reducing display apparatus' thickness and weight. Also, the organic light-emitting display apparatus shows high-grade characteristics, such as low power consumption, high luminance, and a fast response time.

SUMMARY

Aspects of one or more exemplary embodiments are directed to a pixel and a display apparatus including the same, which displays an image having uniform or substantially uniform luminance.

Additional aspects will be set forth in part in the description which follows and, in part, will be apparent from the description, or may be learned by practice of the presented embodiments.

According to one or more exemplary embodiments, there is provided a pixel including: an organic light-emitting diode (OLED); a capacitor connected between a first node and a second node; a first transistor including a gate electrode connected to the second node, a first electrode connected to a first source voltage line, and a second electrode configured to output a current corresponding to a voltage applied to the second node; a second transistor including a gate electrode connected to a first scan line for receiving a first scan signal, a first electrode connected to a data line, and a second electrode connected to the first node; a third transistor including a gate electrode connected to the first scan line, a first electrode connected to the second electrode of the first transistor, and a second electrode connected to the gate electrode of the first transistor; a fourth transistor including a gate electrode connected to a second scan line for receiving a second scan signal, a first electrode connected to the second electrode of the first transistor, and a second electrode connected to an initialization voltage line; and a fifth transistor including a gate electrode and a second electrode connected to an emission control line for receiving an emission control signal, and a first electrode connected to the first node.

In an embodiment, the pixel further includes a sixth transistor including a gate electrode connected to the emission control line, a first electrode connected to the second electrode of the first transistor, and a second electrode connected to an anode electrode of the OLED.

In an embodiment, during a portion of a period in which a data signal from the data line is transmitted to the first node through the second transistor which is turned on by the first scan signal, the third transistor is turned on by the first scan signal, and the fourth transistor is turned on by the second scan signal to transmit an initialization voltage to the second node.

In an embodiment, during an other portion of the period in which the data signal is transmitted to the first node, the fourth transistor is turned off, and a voltage of the second node is set to a value equal to a difference between a threshold voltage of the first transistor and a first source voltage supplied to the first source voltage line.

In an embodiment, during a period in which at least one of the first scan signal and the second scan signal is at a first voltage level, the emission control signal is at a second voltage level, and the fifth transistor and the sixth transistor are turned off.

In an embodiment, when the fifth transistor and the sixth transistor are turned on by the emission control signal having the first voltage level, a voltage of the first node drops to the first voltage level of the emission control signal, a voltage of the second node changes, and the first transistor is turned on by the voltage of the second node to output the current.

In an embodiment, one frame in which the pixel operates includes: a first period in which the first scan signal and the second scan signal are at a first voltage level, and the emission control signal is at a second voltage level; a second period in which the first scan signal is at the first voltage level, and the second scan signal and the emission control signal are at the second voltage level; and a third period in which the first scan signal and the second scan signal are at the second voltage level, and the emission control signal is at the first voltage level.

According to one or more exemplary embodiments, there is provided an organic light-emitting display apparatus including: a scan driver configured to sequentially supply a first scan signal to a plurality of first scan lines, and to sequentially supply a second scan signal to a plurality of second scan lines; an emission controller configured to sequentially supply an emission control signal to a plurality of emission control lines; a data driver configured to respectively supply data signals to a plurality of data lines; and a display unit including a plurality of pixels connected to the plurality of first scan lines, the plurality of second scan lines, the plurality of emission control lines, and the plurality of data lines, wherein each of the plurality of pixels includes: an organic light-emitting diode (OLED); a capacitor connected between a first node and a second node; a first transistor including a gate electrode connected to the second node, a first electrode connected to a first source voltage line, and a second electrode outputting a current corresponding to a voltage applied to the second node; a second transistor including a gate electrode connected to one of the plurality of first scan lines, a first electrode connected to one of the plurality of data lines, and a second electrode connected to the first node; a third transistor including a gate electrode connected to the first scan line, a first electrode connected to the second electrode of the first transistor, and a second electrode connected to the gate electrode of the first transistor; a fourth transistor including a gate electrode connected to one of the plurality of second scan lines, a first electrode connected to the second electrode of the first transistor, and a second electrode connected to an initialization voltage line; and a fifth transistor including a gate electrode, a second electrode, and a first electrode connected to the first node, the gate and second electrodes being connected to one of the plurality of emission control lines.

In an embodiment, each of the plurality of pixels further includes a sixth transistor including a gate electrode connected to a corresponding one of the plurality of emission control lines, a first electrode connected to the second electrode of the first transistor, and a second electrode connected to an anode electrode of the OLED.

In an embodiment, in a first period of one frame, the scan driver applies the first and second scan signals having a first voltage level, in a second period of the one frame, the scan driver applies the first scan signal having the first voltage level, and to apply the second scan signal having a second voltage level, in a third period of the one frame, the scan driver applies the first and second scan signals having the second voltage level, in the first period and the second period of the one frame, the emission controller applies the emission control signal having the second voltage level, and in the third period of the one frame, the emission controller applies the emission control signal having the first voltage level.

In an embodiment, in the first period of the one frame, the second transistor is turned on by the first scan signal having the first voltage level, and a data signal from the data line is transmitted to the first node when turned on, and the third transistor is turned on by the first scan signal having the first voltage level, the fourth transistor is turned on by the second scan signal having the first voltage level, and an initialization voltage is supplied to the second node via the initialization voltage line when turned on.

In an embodiment, in the second period of the one frame, while the data signal is being transmitted to the first node, the fourth transistor is turned off by the second scan signal having the second voltage level, and a voltage of the second node is set to a value equal to a difference between a threshold voltage of the first transistor and a first source voltage.

In an embodiment, each of the plurality of pixels further includes a sixth transistor including a gate electrode connected to a corresponding one of the plurality of emission control lines, a first electrode connected to the second electrode of the first transistor, and a second electrode connected to an anode electrode of the OLED.

In an embodiment, in the third period of the one frame, the fifth transistor and the sixth transistor are turned on by the emission control signal having the first voltage level, a voltage of the first node is dropped to the second voltage level of the emission control signal, a voltage of the second node is changed, and the first transistor is turned on by the voltage of the second node to output the current.

BRIEF DESCRIPTION OF THE DRAWINGS

These and/or other aspects will become apparent and more readily appreciated from the following description of the exemplary embodiments, taken in conjunction with the accompanying drawings in which.

DETAILED DESCRIPTION

Figure 1:
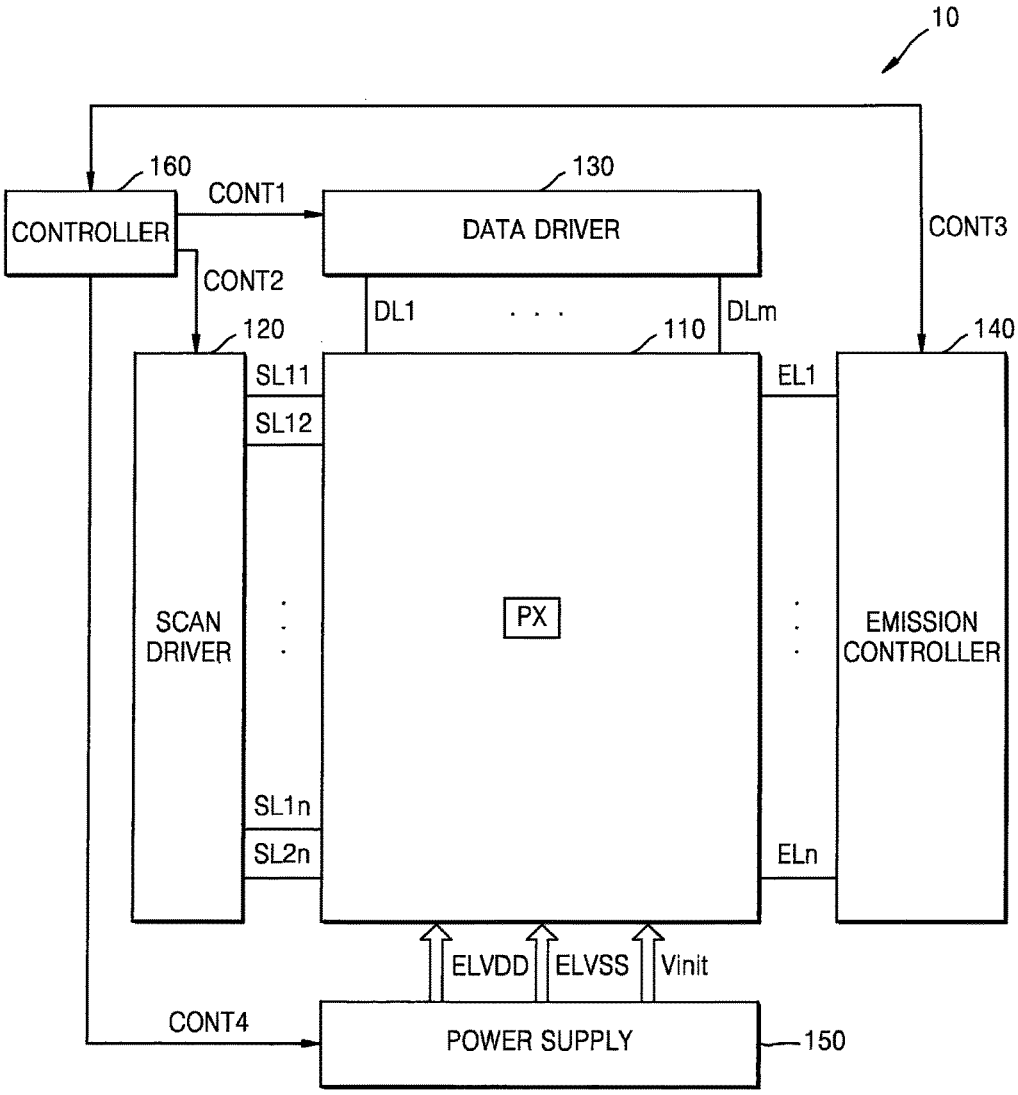
FIG. 1 is a circuit diagram schematically illustrating a structure of an organic light-emitting display apparatus according to an exemplary embodiment of the present invention.

Reference will now be made in detail to exemplary embodiments, examples of which are illustrated in the accompanying drawings, wherein like reference numerals refer to like elements throughout. In this regard, the present exemplary embodiments may have different forms and should not be construed as being limited to the descriptions set forth herein. Accordingly, the exemplary embodiments are merely described below, by referring to the figures, to explain aspects of the present description.

The present inventive concept may have various embodiments, and specific embodiments illustrated in the drawings will be described in detail in the detailed description. The effects and features of the inventive concept will become apparent from the following description of the embodiments with reference to the accompanying drawings, which is set forth hereinafter. The inventive concept may, however, be embodied in different forms and should not be construed as being limited to the embodiments set forth herein.

Hereinafter, embodiments of the inventive concept will be described in detail with reference to the accompanying drawings. In addition, in the present specification and drawings, like reference numerals refer to like elements throughout, and thus, redundant descriptions may not be provided.

It will be understood that, although the terms "first", "second", "third", etc., may be used herein to describe various elements, components, regions, layers and/or sections, these elements, components, regions, layers and/or sections should not be limited by these terms. These terms are used to distinguish one element, component, region, layer or section from another element, component, region, layer or section. Thus, a first element, component, region, layer or section discussed below could be termed a second element, component, region, layer or section, without departing from the spirit and scope of the inventive concept.

In addition, it will also be understood that when a layer is referred to as being "between" two layers, it can be the only layer between the two layers, or one or more intervening layers may also be present.

The terminology used herein is for the purpose of describing particular embodiments and is not intended to be limiting of the inventive concept. As used herein, the singular forms "a" and "an" are intended to include the plural forms as well, unless the context clearly indicates otherwise.

It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items. Expressions such as "at least one of," when preceding a list of elements, modify the entire list of elements and do not modify the individual elements of the list. Further, the use of "may" when describing embodiments of the inventive concept refers to "one or more embodiments of the inventive concept." Also, the term "exemplary" is intended to refer to an example or illustration.

It will be understood that when an element or layer is referred to as being "on", "connected to", "coupled to", or "adjacent to" another element or layer, it can be directly on, connected to, coupled to, or adjacent to the other element or layer, or one or more intervening elements or layers may be present. When an element or layer is referred to as being "directly on," "directly connected to", "directly coupled to", or "directly mounted to" another element or layer, there are no intervening elements or layers present.

As used herein, the term "substantially," "about," and similar terms are used as terms of approximation and not as terms of degree, and are intended to account for the inherent deviations in measured or calculated values that would be recognized by those of ordinary skill in the art.

As used herein, the terms "use," "using," and "used" may be considered synonymous with the terms "utilize," "utilizing," and "utilized," respectively.

FIG. 1 is a circuit diagram schematically illustrating a structure of an organic light-emitting display apparatus 10 according to an exemplary embodiment of the present invention.

Referring to FIG. 1, the organic light-emitting display apparatus 10, according to an exemplary embodiment, includes a display unit (or pixel unit) 110, a scan driver 120, a data driver 130, an emission controller 140, a power supply 150, and a controller 160.

The display unit 110 includes a plurality of scan lines SL11 to SL2*n* (where n is an integer greater than one), a plurality of data lines DL1 to DLm (where m is an integer greater than one), and a plurality of pixels PX. The plurality of scan lines SL11 to SL2*n* are arranged in rows and are separated from each other at certain intervals, and transfer (e.g., transmit) scan signals. The plurality of data lines DL1 to DLm are arranged in column to be separated from each other at certain intervals, and respectively transfer data signals. The plurality of scan lines SL11 to SL2*n* and the plurality of data lines DL1 to DLm are arranged in a grid-like (e.g., matrix-like) manner, and the plurality of pixels PX are respectively provided at crossing portions between the plurality of scan lines SL11 to SL2*n* and the plurality of data lines DL1 to DLm. The display unit 110 may further include a plurality of emission control lines EL1 to ELn. The plurality of emission control lines EL1 to ELn are arranged in row to be separated from each other in parallel, and transfer emission control signals.

The scan driver 120 is connected to the scan lines SL11 to SL2*n* of the display unit 110, and generates the scan signal based on a combination of a gate-on voltage and a gate-off voltage according to a second control signal CONT2 to apply the scan signal to the scan lines SL11 to SL2*n*. When the scan signal has the gate-on voltage, a switching transistor of a pixel connected to a corresponding scan line is turned on.

The data driver 130 is connected to the data lines DL1 to DLm of the display unit 110, and respectively applies the data signals representing gray scale levels to the plurality of data lines DL1 to DLm according to a first control signal CONT1. The data driver 130 converts input image data having a gray scale level, input from the controller 160, into a data signal corresponding to a voltage or a current.

The emission controller 140 is connected to the emission control lines EL1 to ELn of the display unit 110, and generates an emission control signal according to a third control signal CONT3 to apply the emission control signal to the emission control line EL1 to ELn. A width of a gate-on voltage section of the emission control signal is set to be equal to or broader than that of a gate-on voltage section of the scan signal. In the exemplary embodiment of FIG. 1, the emission controller 140 is separately provided. However, the emission controller 140 may be omitted, and the scan driver 120 may apply the emission control signal to the emission control signals EL1 to ELn.

The power supply 150 generates a first source voltage ELVDD and a second source voltage ELVSS according to a fourth control signal CONT4. The power supply 150 applies the generated first source voltage ELVDD and second source voltage ELVSS to the display unit 110. A voltage level of the first source voltage ELVDD is higher than a voltage level of the second source voltage ELVSS. The power supply 150 generates an initialization voltage Vinit according to the fourth control signal CONT4 to apply the initialization voltage Vinit to the display unit 110.

The controller 160 receives, from an external graphic controller, input image data and an input control signal for controlling the display of the input image data. The input control signal includes, for example, a vertical sync signal Vsync, a horizontal sync signal Hsync, and a main clock MCLK. The controller 160 transfers (e.g., transmits) input image data to the data driver 130, generates the first control signal CONT1 to transfer the first control signal CONT1 to the data driver, and generates the second control signal CONT2 to the scan driver 120. The first control signal CONT1 includes a horizontal sync start signal STH, indicating the transfer of input image data to pixels PX of one row, and a clock signal. The second control signal CONT2 includes a scan start signal SSP indicating the start of scan and a plurality of clock signals SCLK. The controller 160 generates the third control signal CONT3, and transfers the third control signal CONT3 to the emission controller 140. The controller 160 generates the fourth control signal CONT4, and transfers the fourth control signal CONT4 to the power supply 150.

Each of the scan driver 120, the data driver 130, the emission controller 140, the power supply 150, and the controller 160 may be implemented as a separate integrated circuit (IC) chip or one IC chip, and thus may be directly mounted on a substrate on which the display unit 110 is provided, mounted on a flexible printed circuit film, attached to a substrate in a tape carrier package (TCP), or directly provided on a substrate.

Figure 2:
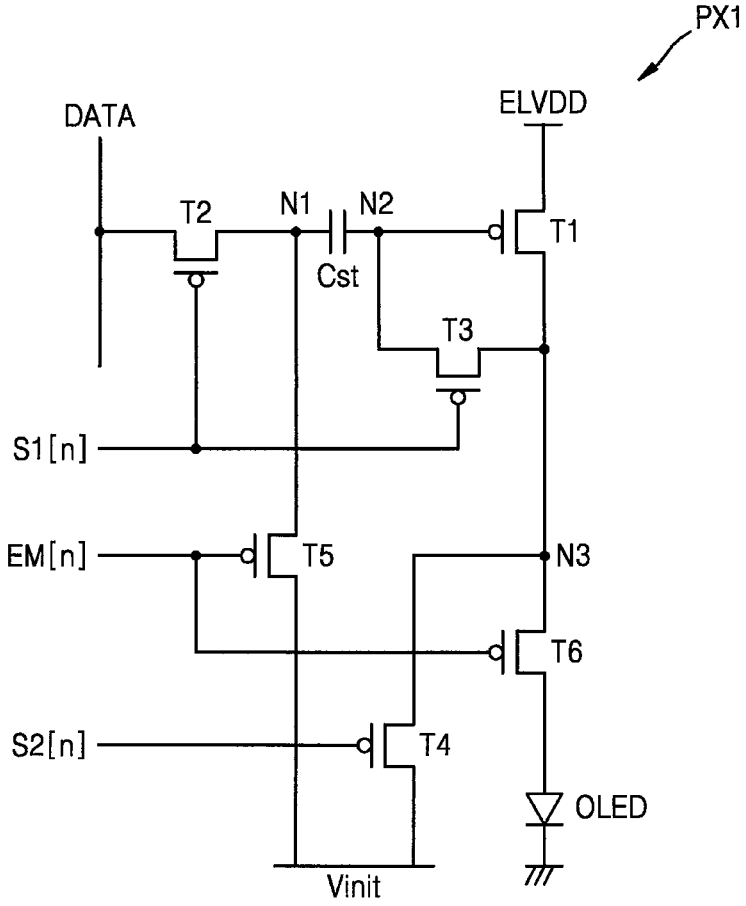
FIG. 2 is a circuit diagram illustrating a pixel according to an exemplary embodiment of the present invention.

FIG. 2 is a circuit diagram illustrating a pixel according to an exemplary embodiment of the present invention.

For convenience of description, FIG. 2 illustrates a pixel PX1 that is connected to an arbitrary data line DLm to receive a data signal DATA, connected to an nth first scan line SL1*n* and an nth second scan line SL2*n* to receive a first scan signal S1[*n*] and a second scan signal S2[*n*], and connected to an nth emission control line ELn to receive an emission control signal EM[n].

Referring to FIG. 2, the pixel PX1 according to an exemplary embodiment includes first to sixth transistors T1 to T6, a capacitor Cst, and an organic light-emitting diode OLED.

The first transistor T1 includes a gate electrode connected to a second node N2, a first electrode connected to a first source voltage line through which the first source voltage ELVDD is applied, and a second electrode connected to a first electrode of the sixth transistor T6. The first transistor T1 acts as a driving transistor, and supplies a current, corresponding to a voltage applied to a second node N2, to the organic light-emitting diode OLED.

The second transistor T2 includes a gate electrode connected to the first scan line SL1*n*, a first electrode connected to the data line DLm, and a second electrode connected to a first node N1. When the first scan signal S1[n] having a gate-on voltage is supplied to the first scan line SL1n, the second transistor T2 is turned on, and transfers (e.g., transmits) the data signal DATA, supplied through the data line DLm, to the first node N1.

The third transistor T3 includes a gate electrode connected to the first scan line SL1n, a first electrode connected to the second electrode of the first transistor T1, and a second electrode connected to the gate electrode of the first transistor T1. When the first scan signal S1[n] having the gate-on voltage is supplied to the first scan line SL1n, the third transistor T3 is turned on, and diode-connects the first transistor T1.

The fourth transistor T4 includes a gate electrode connected to the second scan line SL2n, a first electrode connected to the second electrode of the first transistor T1, and a second electrode connected to an initialization voltage line through which the initialization voltage Vinit is applied. When the second scan signal S2[n] having the gate-on voltage is supplied to the second scan line SL2n, the fourth transistor T4 is turned on, and transfers the initialization voltage Vinit to the third node N3.

The fifth transistor T5 includes a gate electrode connected to the emission control line ELn, a first electrode connected to the first node N1, and a second electrode connected to the initialization voltage line. When the emission control signal EM[n] having a gate-on level is supplied through the emission control line ELn, the fifth transistor T5 is turned on, and changes a voltage value of the first node N1 to a voltage value of the initialization voltage Vinit.

The sixth transistor T6 includes a gate electrode connected to the emission control line ELn, the first electrode connected to the second electrode of the first transistor T1, and a second electrode connected to an anode electrode of the organic light-emitting diode OLED. When the sixth transistor T6 is supplied with the emission control signal EM[n] having the gate-on voltage through the emission control line ELn, the sixth transistor T6 is turned on, and supplies a current from the first transistor T1 to the organic light-emitting diode OLED.

The capacitor Cst is connected between the first node N1 and the second node N2, and is charged with a voltage equal to the difference between a voltage of the first node N1 and a voltage of the second node N2.

The organic light-emitting diode OLED includes the anode electrode connected to the second electrode of the sixth transistor T6, and a cathode electrode connected to the second source voltage ELVSS. The second source voltage ELVSS has a lower level than that of the first source voltage ELVDD. The organic light-emitting diode OLED generates light having certain luminance in response to an amount of current supplied from the first transistor T1.

The pixel PX1 of FIG. 2 uses the initialization voltage Vinit for sustaining a data voltage corresponding to a data signal of the first node N1, and for initializing the gate electrode of the first transistor T1. Therefore, the voltage for sustaining the data voltage and the voltage for initializing the gate electrode of the first transistor T1 cannot be set as optimal voltages.

Figure 3:
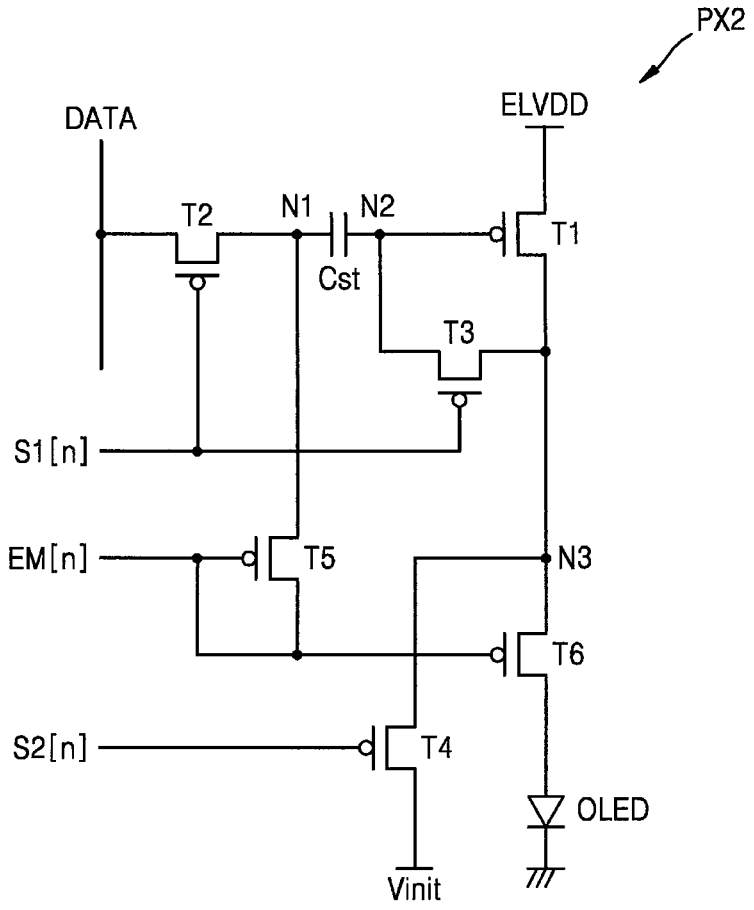
FIG. 3 is a circuit diagram illustrating a pixel according to another exemplary embodiment of the present invention.

FIG. 3 is a circuit diagram illustrating a pixel according to another exemplary embodiment of the present invention.

For convenience of description, FIG. 3 illustrates a pixel PX2 that is connected to an arbitrary data line DLm to receive a data signal DATA, connected to an nth first scan line SL1n and an nth second scan line SL2n to receive a first scan signal S1[n] and a second scan signal S2[n], and connected to an nth emission control line ELn to receive an emission control signal EM[n].

Referring to FIG. 3, the pixel PX2 according to an exemplary embodiment includes first to sixth transistors T1 to T6, a capacitor Cst, and an organic light-emitting diode OLED.

The first transistor T1 includes a gate electrode connected to a second node N2, a first electrode connected to a first source voltage line through which the first source voltage ELVDD is applied, and a second electrode connected to a first electrode of the sixth transistor T6. The first transistor T1 acts as a driving transistor, and supplies a current, corresponding to a voltage applied to a second node N2, to the organic light-emitting diode OLED.

The second transistor T2 includes a gate electrode connected to the first scan line SL1n, a first electrode connected to the data line DLm, and a second electrode connected to a first node N1. When the first scan signal S1[n] having a gate-on voltage is supplied to the first scan line SL1n, the second transistor T2 is turned on, and transfers (e.g., transmits) the data signal DATA, supplied through the data line DLm, to the first node N1.

The third transistor T3 includes a gate electrode connected to the first scan line SL1n, a first electrode connected to the second electrode of the first transistor T1, and a second electrode connected to the gate electrode of the first transistor T1. When the first scan signal S1[n] having the gate-on voltage is supplied to the first scan line SL1n, the third transistor T3 is turned on, and diode-connects the first transistor T1.

The fourth transistor T4 includes a gate electrode connected to the second scan line SL2n, a first electrode connected to the second electrode of the first transistor T1, and a second electrode connected to an initialization voltage line through which the initialization voltage Vinit is applied. When the second scan signal S2[n] is supplied to the second scan line SL2n, the fourth transistor T4 is turned on.

The fifth transistor T5 includes a gate electrode and a second electrode, which are connected to the emission control line ELn, and a first electrode connected to the first node N1. When the emission control signal EM[n] having the gate-on voltage is supplied through the emission control line ELn, the fifth transistor T5 is turned on and diode-connected, and changes a voltage value of the first node N1 to a voltage value of the gate-on voltage of the emission control signal EM[n].

The sixth transistor T6 includes a gate electrode connected to the emission control line ELn, the first electrode connected to the second electrode of the first transistor T1, and a second electrode connected to an anode electrode of the organic light-emitting diode OLED. When the sixth transistor T6 is supplied with the emission control signal EM[n] having the gate-on voltage through the emission control line ELn, the sixth transistor T6 is turned on, and supplies a current from the first transistor T1 to the organic light-emitting diode OLED.

The capacitor Cst is connected between the first node N1 and the second node N2, and is charged with a voltage equal to the difference between a voltage of the first node N1 and a voltage of the second node N2.

The organic light-emitting diode OLED includes the anode electrode connected to the second electrode of the sixth transistor T6 and a cathode electrode connected to the second source voltage ELVSS. A voltage value of the second source voltage ELVSS is set lower than a voltage value of the first source voltage ELVDD. The organic light-emitting diode OLED generates light having a certain luminance in response to an amount of current supplied from the first transistor T1.

Figure 4:
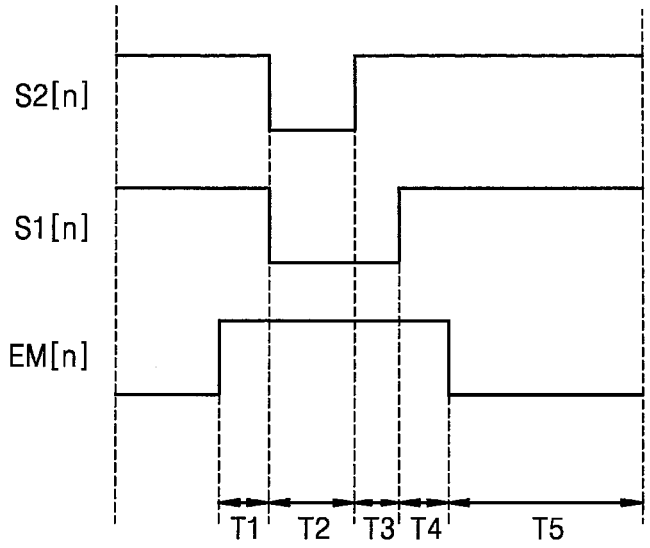
FIG. 4 is a timing diagram for illustrating a method of driving the pixel of FIG. 3, according to an exemplary embodiment of the present invention.

FIG. 4 is a timing diagram for describing a method of driving the pixel of FIG. 3, according to an exemplary embodiment of the present invention.

In a first period T1, the first scan signal S1 [n] having a high level is applied to the first scan line SL1*n*, the second scan signal S2[*n*] having a high level is applied to the second scan line SL2*n*, and the emission control signal EM[n] having a high level is applied to the emission control line ELn. Therefore, the first to sixth transistors T1 to T6 are turned off.

In a second period T2, the first scan signal S1[*n*] having a low level is applied to the first scan line SL1*n*, and the second scan signal S2[*n*] having a low level is applied to the second scan line SL2*n*. The emission control signal EM[n] having a high level is applied to the emission control line ELn.

The second transistor T2 and the third transistor T3 are turned on by the first scan signal S1[*n*] having a low level. The fourth transistor T4 is turned on by the second scan signal S2[*n*] having a low level.

When the second transistor T2 is turned on, the data signal DATA supplied through the data line DLm is supplied to the first node N1. When the fourth transistor T4 and the third transistor T3 are turned on, the initialization voltage Vinit is supplied to the second node N2. The initialization voltage Vinit is set as a lower voltage than a voltage of the data signal DATA.

That is, in the second period T2, the gate electrode of the first transistor T1 is initialized, and the data signal DATA is applied to the pixel PX1.

In a third period T3, the first scan signal S1[*n*] having a low level is maintained on the first scan line SL1*n*, the emission control signal EM[n] having a high level is maintained on the emission control line ELn, and the second scan signal S2[*n*] applied to the second scan line SL2*n* is shifted to a high level. Therefore, the fourth transistor T4 is turned off. At this time, because the first transistor T1 is diode-connected, a voltage value of the second node N2 is set as a value that is obtained by subtracting a threshold voltage of the first transistor T1 from a voltage value of the first source voltage ELVDD. The capacitor Cst is charged with a voltage difference between the first node N1 and the second node N2.

That is, in the third period T3, the threshold voltage of the first transistor 1 is compensated for.

In a fourth period T4, the second scan signal S2[*n*] having a high level is maintained on the second scan line SL2*n*, the emission control signal EM[n] having a high level is maintained on the emission control line ELn, and the first scan signal S1[*n*] supplied to the first scan line SL1*n* is shifted to a high level. Therefore, the second transistor T2 and the third transistor T3 are turned off.

Subsequently, in a fifth period T5, the emission control signal EM[n] having a high level is shifted to a low level. Therefore, the fifth transistor T5 and the sixth transistor T6 are turned on. When the fifth transistor T5 is turned on, a voltage value of the first node N1 is dropped to a low-level voltage value of the emission control signal EM[n]. That is, the voltage value of the first node N1 is dropped from a voltage value of the data signal DATA to the low-level voltage value of the emission control signal EM[n]. In this case, the third transistor T3 is turned off, and thus, the second node N2 is floated, whereby a voltage value of the second node N2 is dropped in correspondence with the voltage value of the first node N1. For example, the voltage value of the second node N2 is dropped by a voltage of the data signal from a voltage value, which is obtained by subtracting the threshold value of the first transistor T1 from the first source voltage ELVDD.

Then, the first transistor T1 supplies a current, corresponding to a voltage value, which is applied to the second node N2 during the fifth period T5, to the organic light-emitting diode OLED via the sixth transistor T6, and thus, the organic light-emitting diode OLED generates light having a certain luminance.

The pixel PX2 of FIG. 3 uses a low-level voltage of the emission control signal EM[n] as an auxiliary voltage for maintaining the data signal independently from the initialization voltage Vinit that initializes the gate electrode of the first transistor T1. An optimal voltage value is set by differentially applying a data signal maintenance voltage and a gate electrode initialization voltage of the driving transistor. Also, by diode-connecting the fifth transistor T5 to the emission control line ELn, a voltage is stably applied, and the data signal is maintained. Also, by diode-connecting the fifth transistor T5 to the emission control line ELn, a separate auxiliary voltage is not needed. Therefore, a degree of free of a design of a pixel and a region margin are enhanced.

In the present embodiment, each of the transistors of a pixel circuit is a P-type transistor. In this case, a gate-on voltage for turning on the transistors is a low-level voltage, and a gate-off voltage for turning off the transistors is a high-level voltage. However, the present embodiment is not limited thereto, and each of the transistors of a pixel circuit may be an N-type transistor. In this case, a gate-on voltage for turning on the transistors is a high-level voltage, and a gate-off voltage for turning off the transistors is a low-level voltage.

As described above, according to the one or more of the above exemplary embodiments, the display apparatus displays an image having uniform or substantially uniform luminance.

It should be understood that the exemplary embodiments described herein should be considered in a descriptive sense only and not for purposes of limitation. Descriptions of features or aspects within each exemplary embodiment should typically be considered as available for other similar features or aspects in other exemplary embodiments.

While one or more exemplary embodiments have been described with reference to the figures, it will be understood by those of ordinary skill in the art that various suitable changes in form and details may be made therein without departing from the spirit and scope of the present invention as defined by the following claims, and equivalents thereto.

What is claimed is:

1. A pixel comprising:

an organic light-emitting diode (OLED);

a capacitor connected between a first node and a second node;

a first transistor comprising a gate electrode connected to the second node, a first electrode connected to a first source voltage line, and a second electrode configured to output a current corresponding to a voltage applied to the second node;

a second transistor comprising a gate electrode connected to a first scan line for receiving a first scan signal, a first electrode connected to a data line, and a second electrode connected to the first node; a third transistor comprising a gate electrode connected to the first scan line, a first electrode connected to the second electrode of the first transistor, and a second electrode connected to the gate electrode of the first transistor;

a fourth transistor comprising a gate electrode connected to a second scan line for receiving a second scan signal, a first electrode connected to the second electrode of the first transistor, and a second electrode connected to an initialization voltage line; and a fifth transistor comprising a gate electrode and a second electrode both connected to an emission control line, the gate and second electrodes and the emission control line being configured to receive an emission control signal, and a first electrode connected to the first node.

2. The pixel of claim 1, further comprising a sixth transistor comprising a gate electrode connected to the emission control line, a first electrode connected to the second electrode of the first transistor, and a second electrode connected to an anode electrode of the OLED.

3. The pixel of claim 2, wherein during a portion of a period in which a data signal from the data line is transmitted to the first node through the second transistor which is turned on by the first scan signal, the third transistor is turned on by the first scan signal, and the fourth transistor is turned on by the second scan signal to transmit an initialization voltage to the second node.

4. The pixel of claim 3, wherein during an other portion of the period in which the data signal is transmitted to the first node, the fourth transistor is turned off, and a voltage of the second node is set to a value equal to a difference between a threshold voltage of the first transistor and a first source voltage supplied to the first source voltage line.

5. The pixel of claim 4, wherein during a period in which at least one of the first scan signal and the second scan signal is at a first voltage level, the emission control signal is at a second voltage level, and the fifth transistor and the sixth transistor are turned off.

6. The pixel of claim 5, wherein when the fifth transistor and the sixth transistor are turned on by the emission control signal having the first voltage level, a voltage of the first node drops to the first voltage level of the emission control signal, a voltage of the second node changes, and the first transistor is turned on by the voltage of the second node to output the current.

7. The pixel of claim 1, wherein one frame in which the pixel operates comprises:

a first period in which the first scan signal and the second scan signal are at a first voltage level, and the emission control signal is at a second voltage level;

a second period in which the first scan signal is at the first voltage level, and the second scan signal and the emission control signal are at the second voltage level; and a third period in which the first scan signal and the second scan signal are at the second voltage level, and the emission control signal is at the first voltage level.

8. An organic light-emitting display apparatus comprising:

a scan driver configured to sequentially supply a first scan signal to a plurality of first scan lines, and to sequentially supply a second scan signal to a plurality of second scan lines;

an emission controller configured to sequentially supply an emission control signal to a plurality of emission control lines;

a data driver configured to respectively supply data signals to a plurality of data lines; and a display unit comprising a plurality of pixels connected to the plurality of first scan lines, the plurality of second scan lines, the plurality of emission control lines, and the plurality of data lines, wherein each of the plurality of pixels comprises:

an organic light-emitting diode (OLED);

a capacitor connected between a first node and a second node;

a first transistor comprising a gate electrode connected to the second node, a first electrode connected to a first source voltage line, and a second electrode outputting a current corresponding to a voltage applied to the second node;

a second transistor comprising a gate electrode connected to one of the plurality of first scan lines, a first electrode connected to one of the plurality of data lines, and a second electrode connected to the first node;

a third transistor comprising a gate electrode connected to the first scan line, a first electrode connected to the second electrode of the first transistor, and a second electrode connected to the gate electrode of the first transistor;

a fourth transistor comprising a gate electrode connected to one of the plurality of second scan lines, a first electrode connected to the second electrode of the first transistor, and a second electrode connected to an initialization voltage line; and a fifth transistor comprising a gate electrode, a second electrode, and a first electrode connected to the first node, the gate and second electrodes both being connected to one of the plurality of emission control lines, the gate and second electrodes and the emission control line being configured to receive the emission control signal.

9. The organic light-emitting display apparatus of claim 8, wherein each of the plurality of pixels further comprises a sixth transistor comprising a gate electrode connected to a corresponding one of the plurality of emission control lines, a first electrode connected to the second electrode of the first transistor, and a second electrode connected to an anode electrode of the OLED.

10. The organic light-emitting display apparatus of claim 9, wherein, in a first period of one frame, the scan driver applies the first and second scan signals having a first voltage level, in a second period of the one frame, the scan driver applies the first scan signal having the first voltage level, and to apply the second scan signal having a second voltage level, in a third period of the one frame, the scan driver applies the first and second scan signals having the second voltage level, in the first period and the second period of the one frame, the emission controller applies the emission control signal having the second voltage level, and in the third period of the one frame, the emission controller applies the emission control signal having the first voltage level.

11. The organic light-emitting display apparatus of claim 10, wherein in the first period of the one frame, the second transistor is turned on by the first scan signal having the first voltage level, and a data signal from the data line is transmitted to the first node when turned on, and the third transistor is turned on by the first scan signal having the first voltage level, the fourth transistor is turned on by the second scan signal having the first voltage level, and an initialization voltage is supplied to the second node via the initialization voltage line when turned on.

12. The organic light-emitting display apparatus of claim 10, wherein in the second period of the one frame, while the data signal is being transmitted to the first node, the fourth transistor is turned off by the second scan signal having the second voltage level, and a voltage of the second node is set to a value equal to a difference between a threshold voltage of the first transistor and a first source voltage.

13. The organic light-emitting display apparatus of claim 10, wherein in the third period of the one frame, the fifth transistor and the sixth transistor are turned on by the emission control signal having the first voltage level, a voltage of the first node is dropped to the second voltage level of the emission control signal, a voltage of the second node is changed, and the first transistor is turned on by the voltage of the second node to output the current.

* * * * *